United States Patent [19]

Kamada et al.

[11] Patent Number: 4,781,383

[45] Date of Patent: Nov. 1, 1988

[54] SOLID THREE-PIECE GOLF BALL

[75] Inventors: Toshihiko Kamada, Kagawa; Shunji Izumi, Tamano; Shinichi Watanabe, Kagawa, all of Japan

[73] Assignee: Kamatari Co., Ltd., Kagawa, Japan

[21] Appl. No.: 879,783

[22] Filed: Jun. 27, 1986

[30] Foreign Application Priority Data

Feb. 4, 1986 [JP] Japan ..... 61-21231

[51] Int. Cl.[4] ..... A63B 37/06

[52] U.S. Cl. ..... 273/228; 273/230

[58] Field of Search ..... 273/218, 220, 228, 229, 273/230, 217, 219

[56] References Cited

U.S. PATENT DOCUMENTS 3,784,209 1/1974 Berman et al. ..... 273/218
4,714,253 12/1987 Nakahara et al. ..... 273/228

FOREIGN PATENT DOCUMENTS 5149840 4/1976 Japan ..... 273/228
0163673 8/1985 Japan ..... 273/218
0241464 11/1985 Japan ..... 273/228
1095615 12/1967 United Kingdom ..... 273/220

*Primary Examiner*—George J. Marlo
*Attorney, Agent, or Firm*—Armstrong, Nikaido, Marmelstein & Kubovcik

[57] ABSTRACT

A solid three piece golf ball made by covering a core, which consists of inner and outer layers, with a shell, the inner layer having a diameter of 24–29 mm and a hardness (Shore hardness D) of 15–30, the outer layer having a diameter of 36–41 mm and a hardness (Shore hardness D) of 55–65, the golf ball having a percentage of the area of the portion of the surface thereof which contacts a club face when the ball is struck by the club within a range of 27–35%.

3 Claims, 1 Drawing Sheet

SOLID THREE-PIECE GOLF BALL

BACKGROUND

This invention relates to a solid three-piece golf ball having a long flying distance, a striking response substantially as good as that of a thread-wound golf ball, and an excellent capability of being controlled.

Golf balls which have generally been used include thread-wound golf balls and solid golf balls such as two-piece golf balls which are typical thereof. In recent years, solid two-piece golf balls have remarkably spread. This is mainly ascribed to excellent durability and flying distance characteristics of the ball. However, the compression (hardness) of the solid two-piece golf ball is generally higher than that of the thread-wound golf ball, and the striking response and the capability of being controlled of the former golf ball are therefore not satisfactorily good. Because of these facts, there is still deep-rooted popularity of thread-wound golf balls among higher-grade golfers including professional golfers.

It is considered that the high capability of being controlled of this kind of golf ball is ascribable to the moderate deformation thereof, which occurs when the ball is struck by a club. Namely, in a two-piece ball having a high compression, the degree of the deformation is low, so that this ball separates early from a club face when it is struck by the club. This makes it difficult to drive this ball in a carry-away stroke. On the other hand, a golf ball having too low a compression separate from a club face too late when it is struck by the club. Therefore, the ball is influenced largely by the characteristics of the club, and more difficult to control.

There is a method of solving these problems of solid two-piece golf balls, in which method the quantities of methacrylic acid and zinc oxide are reduced from a mixture for the core of a two-piece ball to soften the core as disclosed in Japanese patent application Kokai publication No. 60-163673. However, according to this method, the long flying distance constituting a characteristic of two-piece balls is sacrificed. Therefore, it is impossible to prevent this inconvenience, i.e., compensate for the decrease in the flying distance of this two-piece ball even if only the shell thereof has been improved.

More methods proposed for the same purpose are disclosed in Japanese patent application Kokai publication Nos. 51-49840 and 60-241464, which are directed to the manufacture of solid three-piece golf balls. However, neither of the golf balls disclosed in these publications has a striking response substantially as good as that of a thread-wound ball, a high capability of being controlled and a long flying distance which is the life of a golf ball.

SUMMARY

The present invention has been developed with a view to eliminating these faults of solid golf balls. It is an object of the present invention to provide a solid three-piece golf ball having a striking response very similar to that of thread-wound golf balls and a high capability of being controlled, without causing a decrease in the flying distance thereof which constitutes the important and essential characteristics, by forming the core of the golf ball of a special material to a special construction, and setting to a special level a percentage of the area of the portion of the ball surface which contacts a club face when the ball is struck by the club.

The gist of the present invention resides in a solid three-piece golf ball consisting of a core composed of inner and outer layers, and a shell with which the core is covered, characterized in that the inner layer has a diameter of 24–29 mm and a hardness (Shore hardness D) of 15–30, the outer layer having a diameter of 36–41 mm and a hardness (Shore hardness D) of 55–65, the percentage of the area of the portion of the ball surface which contacts a club face when the ball is struck by the club being 27–35%.

The above and other objects as well as advantageous features of the present invention will become apparent from the following description of the preferred embodiments.

THE PREFERRED EMBODIMENTS

Figure 1:
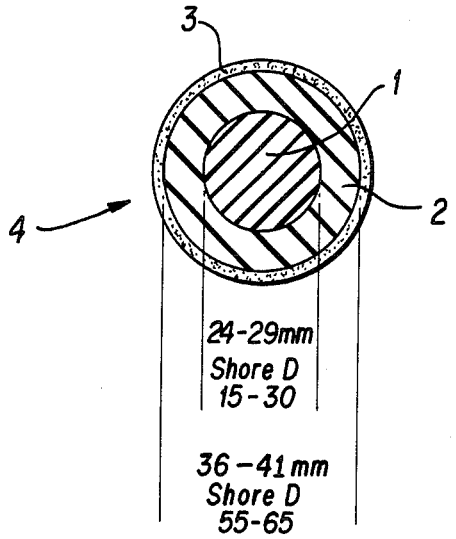
FIG. 1 is a sectional view of a three-piece golf ball according to the invention.

As illustrated in FIG. 1, the solid three-piece golf ball 4 according to the present invention is made up of an inner layer 1, an outer layer 2, and a shell 3. The ball is made by covering the outer surface of an inner layer 1 with an outer layer 2 to form a core, and covering the outer surface of the core with a shell 3. According to the present invention, the following limitations (1)–(3) are placed on the solid three-piece golf ball of such construction.

(1) The diameter of the inner layer shall be 24–29 mm, and the hardness (Shore hardness D) thereof 15–30.

The reasons why the diameter of the inner layer is set to 24–29 mm reside in the following. When the diameter of the inner layer is set to less than 24 mm, the thickness of the shell increases, and the percentage of the area of the portion of the ball surface which contacts a club face when the ball is struck by the club does not reach 27%. As a result, the striking response of the ball becomes sharp, and the capability of being controlled thereof lowers. When the diameter of the inner layer exceeds 29 mm, the thickness of the shell decreases to a low level, and the percentage of the portion mentioned above of the ball surface becomes higher than 35%. Consequently, the ball becomes too soft, and the striking response to the ball is deteriorated.

When the hardness (Shore hardness D) of the inner layer is less than 15, the striking response of the ball is too dull. When this hardness exceeds 30, the striking response of the ball becomes too sharp.

The inner layer having such a hardness (Shore hardness D) consists of a mixture of, for example, 100 parts by weight of cis-1, 4-polybutadiene, 3–15 parts by weight of trimethylol propane trimethacrylate, and zinc oxide.

(2) The diameter of the outer layer shall be 36–41 mm, and the hardness (Shore hardness D) thereof 55–65.

The reasons why the diameter of the outer layer is set to 36–41 mm reside in the following. When the diameter of the outer layer is less than 36 mm, the thickness of the shell becomes too large. Consequently, the ball becomes too hard, and, moreover, the flying distance thereof decreases. When the diameter of the outer layer exceeds 41 mm, the thickness of the shell becomes too small, and the cutting resistance of the ball lowers. This causes a great decrease in the lifetime of the ball.

The reasons why the hardness (Shore hardness D) is set to 55–65 reside in the following. When the hardness of the outer layer is less than 55, the ball becomes too soft. As a result, the striking response of the ball becomes dull, and, moreover, the flying distance thereof decreases. When this hardness exceeds 65, the ball becomes too hard. Consequently, the striking response becomes too sharp, and the striking response similar to that of a thread-wound ball cannot substantially be obtained.

The outer layer having such a hardness (Shore hardness D) consists of a mixture of, for example, 100 parts by weight of cis-1,4-polybutadiene, 25–40 parts by weight of zinc diacrylate, and zinc oxide.

Figure 2:
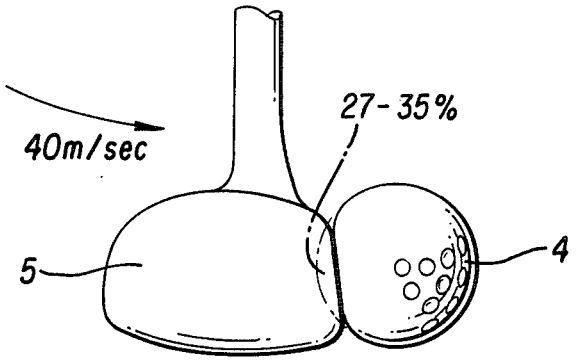
FIG. 2 is a side view showing the striking face of a golf club in contact with a golf ball according to the present invention.

(3) As illustrated in FIG. 2, the percentage of the area of the portion of the ball 4 which contacts a club face when the ball 4 is struck by the club 5 shall be 27–35%.

The present inventors asked golfers in various grades from male professional golfers down to female amateur golfers for help in testing the striking response of various balls prepared by the inventors including the capability of being controlled of the balls. The inventors also measured the flying distances of these balls by using a swing robot, and then made an analysis of the results of all of these tests to discover that a satisfactory ball can be obtained when the degree of deformation of a ball which occurs when the ball is struck by a club, i.e., the percentage of the area of the portion of the surface of the ball which contacts the club face when the ball is struck by the club is set within a certain range. The inventors limited this percentage of area of contact surface portion to 27–35% on the basis of this knowledge.

The percentage of the area of contact surface portion of each ball was determined by dividing the area of the portion of the surface of a ball which contacted the face of a driver (wood club #1) when the ball was struck by the driver at a head speed of 40 m/sec by the area of a diametrical cross section of the ball, and multiplying the quotient by 100.

The effects of the present invention will now be described concretely with reference to Examples and Comparative Examples.

EXAMPLES AND COMPARATIVE EXAMPLES

Example 1

100 parts by weight of cis-1,4-polybutadiene (BR-11 manufactured by Japan Synthetic Rubber Co., Ltd., Japan), 13 parts by weight of trimethylol propane trimethacrylate (TMPT manufactured by Shin Nakamura Chemical Co., Ltd., Japan), 63 parts by weight of zinc oxide (No. 3 zinc white manufactured by Hakusui Chemical Ind. Co., Ltd., Japan), 2 parts by weight of N,N-m-phenylene dimaleimide (Vulnoc PM manufactured by Ouchi Shinko Chemical Ind. Co., Ltd., Japan), 1 part by weight of 2,2-methylene-bis(4-ethy-t-tert-butyl phenol) (Sundant 425 manufactured by Sanshin Chemical Ind. Co., Ltd., Japan) and 2 parts by weight of dicumyl peroxide (Percumyl D manufactured by Nippon Oils & Fat Co., Ltd., Japan) were mixed and kneaded in a kneader. The kneaded product was cured in a metal mold of 25 mm in diameter by heating the same under pressure at 160° C. for 20 minutes to obtain an inner spherical layer of a core, which had a surface hardness (Shore hardness D) of 30. This inner layer was ground to the highest possible sphericalness by a centerless grinder to obtain an inner layer of a core, which had a rough surface and a diameter of 24.4 mm.

100 parts by weight of cis-1,4-polybutadiene (BR-11 manufactured by Japan Synthetic Rubber Co., Ltd., Japan), 38 parts by weight of zinc diacrylate (manufactured by Asada Chemical Ind. Co., Ltd., Japan), 5 parts by weight of zinc oxide (No. 3 zinc white manufactured by Hakusui Chemical Ind. Co., Ltd., Japan), 2 parts by weight of N,N-m-phenylene maleimide (Vulnoc PM manufactured by Ouchi Shinko Chemical Ind. Co., Ltd., Japan), 1 part by weight of 2,2-methylene-bis(4-ethyl-t-tert-butyl phenol) (Sundant 425 manufactured by Sanshin Chemical Ind. Co., Ltd., Japan) and 2 parts by weight of n-butyl 4,4-bis (t-butyl peroxy) valerate, Perhexa V manufactured by Nippon Oils & Fat Co., Ltd., Japan) were mixed and kneaded in a kneader. Two hemispherical premolded products of this kneaded material were obtained by using a metal mold. The inner layer of a core, which was previously molded was covered with these two hemispherical products, and the resultant product was cured by heating the same under pressure at 150° C. for 20 minutes in a metal mold of a diameter of 39.5 mm. The surface hardness (Shore hardness D) of the resultant outer layer of the core was 64.

The core thus obtained, which consisted of the inner and outer layers was ground to the highest possible sphericalness by a centerless grinder to make the outer surface thereof rough and thereby obtain a core of 38.3 mm in diameter.

This core was then coated with a resin, which contained as a main component ionomer resin (Hi-Milan 1706 manufactured by Du Pont-Mitsui Polychemical Co., Ltd., Japan), by an injection molding method using a metal mold for the production of a golf ball of 43.0 mm in diameter. The resultant product was subjected to finishing steps, such as a polishing step and a painting step to obtain a solid three-piece golf ball of the Americal size (large size). The thickness of the shell was 2.20 mm.

The golf ball thus produced was struck for trial by a driver, a wood club, (43 inches, loft 10°, swing balance $D_0$) by using a swing robot, which is manufactured by True Temper Sports Inc. (U. S. A.), at a head speed of 40 m/sec to measure the flying distance (carry and distance) of the ball and the percentage of the area of the portion of the surface of the ball which contacts the club face when the ball is struck by the club. The percentage of area of the surface portion contacting the club face was determined by pasting pressure sensitive paper (Parshot purchased from Lite Shokai Kabushiki Kaisha, Japan) on the club face, and measuring the area of an impression of a golf ball, which was left on the pressure sensitive paper after the ball was struck. The area thus determined was divided by a maximum cross-sectional area (the cross-sectional area of a diametrical portion of the ball) of the golf ball, and the quotient was multiplied by 100 to indicate in percentage the area of the surface portion contacting the club face when the ball was struck by the club.

Another kind of tests, i.e. sensitive tests including the tests for determining the striking response and capability of being controlled of a golf ball, which golfers received or realized when they struck the ball, were conducted with the assistance of male golfers including professional golfers who swing clubs at a head speed of around 46 m/sec, high-grade male golfers who swing clubs at a head speed of around 40 m/sec, and senior male golfers and high-grade female golfers who swing clubs at a head speed of around 32 m/sec.

The percentage of area of the contacting surface portion of this ball with respect to a head speed of 40 m/sec was 28.8%. The results of the tests conducted by the golfers were as shown in Table 2 below. As shown in Table 2, the striking response and capability of being controlled of the balls, which were received and realized by the players, were closer to those of a thread-wound ball than conventional solid two-piece golf balls. The flying distance of the ball in this embodiment was longer than that of thread-wound balls, and as long as that of two-piece balls.

Examples 2–7

In each of Examples 2 and 3, a solid three-piece golf ball of the American size was obtained from a mixture, the compounding ratio of which was set as in Table 1, by the same method as used in Embodiment 1.

In each of Examples 4 and 5, the molding of a starting mixture was done in the same manner as in Example 1 to obtain a golf ball of the American size except that the compounding ratio of the mixture was set as in Table 1; and the inner layer of the core was molded to a diameter of 28.0 mm by using a metal mold of 29 mm in diameter.

In each of Examples 6 and 7, the inner layer was molded by a metal mold of 25 mm in diameter (the metal mold used to mold the outer layer had a diameter of 38.5 mm). A core consisting of these inner and outer layers was subjected to molding and finishing steps according to the same method as in Example 1 by using a metal mold of 41.40 mm in diameter for golf balls, to obtain a golf ball of the British size (small size).

The solid three-piece golf balls thus obtained were tested by the same method as in Example 1. The results of the tests are shown in Table 2. It is clear from Table 2 that the balls in Examples 2–7 are also excellent with respect to the striking response, flying distance and capability of being controlled.

Comparative Examples 1–6 and Standard Example 1

In each of Comparative Examples 1 and 2, a mixture having the compounding ratio shown in Table 1 was subjected to the same molding method by which a conventional solid two-piece golf ball is obtained. Namely, the mixture was placed in a metal mold of 39.5 mm in diameter and heated under pressure at 160° C. for 20 minutes to cure the same. The resultant product was ground by a centerless grinder to form a rough outer surface thereof and thereby obtain a molded core of 38.3 mm. The core was covered with a shell in the same manner as in Example 1. The resultant product was subjected to a finishing process to obtain a solid two-piece golf ball of the standard American size.

In each of Comparative Examples 3 and 4, a mixture having the compounding ratio shown in Table 1 was molded and finished by the same methods as in Comparative Examples 1 and 2 except that a core-molding metal mold of 38.5 mm in diameter and a gold ball-molding metal mold of 41.4 mm in diameter were used, to obtain a solid two-piece golf ball of the British size (small size).

In each of Comparative Examples 5 and 6, a mixture having the compounding ratio shown in Table 1 was used, and a solid two-piece golf ball of the American size was obtained by the same method as used in Example 1.

In Standard Example 1, a thread-wound golf ball of the American size, which is used generally in a regular golf course, was made, and it was used for reference.

The golf balls prepared in these Comparative Examples and Standard Example were tested by the same testing method as used in Example 1, to obtain the results shown in Table 2.

The percentage of area of the contacting surface portion of each ball, which was used to evaluate the properties thereof, was a percentage determined when the ball was struck by a club at a head speed of 40 m/sec. According to the results of experiments made by the present inventors, in which the percentage of area of contacting surface portion of a golf ball was measured with a head speed varied in a wide range from 32 m/sec to 46 m/sec, the head speed and the percentage of area of contacting surface portion of a golf ball have a substantially linear relation. Namely, it was ascertained that, the higher the head speed is, the larger the percentage of area of contacting surface portion of a golf ball is, and that this tendency holds true in any kind of golf balls. It was made sure on the basis of these facts that the properties of a golf ball can be rated with reference to its percentage of area of contacting surface portion with respect to a head speed of 40 m/sec.

TABLE 1

| | Ex. 1 | Ex. 2 | Ex. 3 | Ex. 4 | Ex. 5 | Ex. 6 | Ex. 7 | Com. 1 | Com. 2 | Com. 3 | Com. 4 | Stnd. 1 | Com. 5 | Com. 6 |
|---|---|---|---|---|---|---|---|---|---|---|---|---|---|---|
| Inner layer mixture | | | | | | | | | | | | | | |
| *1 | 100 | 100 | 100 | 100 | 100 | 100 | 100 | | | | | | 100 | 100 |
| *2 | 13 | 10 | 3 | 3 | 3 | 13 | 3 | | | | | | | 2 |
| *3 | | | | | | | | | | | | | 18 | |
| *4 | 63 | 63 | 63 | 57 | 57 | 175 | 180 | | | | | | 62 | 64 |
| *5 | 2 | 2 | 2 | 2 | 2 | 2 | 2 | | | | | | 2 | 2 |
| *6 | 1 | 1 | 1 | 1 | 1 | 1 | 1 | | | | | | 1 | 1 |
| *7 | 2 | 2 | 2 | 2 | 1.8 | 2 | 1.8 | | | | | | 2 | 15 |
| Outer layer mixture | | | | | | | | | | | | | | |
| *1 | 100 | 100 | 100 | 100 | 100 | 100 | 100 | | | | | | 100 | 100 |
| *3 | 38 | 30 | 30 | 38 | 25 | 38 | 30 | | | | | | 30 | 30 |
| *4 | 5 | 5 | 5 | 5 | 6 | 5 | 5 | | | | | | 5 | 5 |
| *5 | 2 | 2 | 2 | 2 | 2 | 2 | 2 | | | | | | 2 | 2 |
| *6 | 1 | 1 | 1 | 1 | 1 | 1 | 1 | | | | | | 1 | 1 |
| *8 | 2 | 2 | 2 | 2 | 2 | 2 | 2 | | | | | | 2 | 2 |
| Core mixture | | | | | | | | | | | | | | |
| *1 | | | | | | | | 100 | 100 | 100 | 100 | | | |
| *3 | | | | | | | | 28 | 20 | 28 | 20 | | | |
| *4 | | | | | | | | 19 | 20 | 50 | 51 | | | |
| *5 | | | | | | | | 2 | | | | | | |
| *6 | | | | | | | | 1 | | | | | | |

TABLE 1-continued

| | Ex. 1 | Ex. 2 | Ex. 3 | Ex. 4 | Ex. 5 | Ex. 6 | Ex. 7 | Com. 1 | Com. 2 | Com. 3 | Com. 4 | Stnd. 1 | Com. 5 | Com. 6 |
|---|---|---|---|---|---|---|---|---|---|---|---|---|---|---|
| *7 | | | | | | | | 2 | | | | | | |

Notes 1:
Ex. = Example, Com. = Comparative Example, Stnd. = Standard Example.
Notes 2:
*1: Cis-1,4-polybutadiene, "BR-11" manufactured by Japan Synthetic Rubber Co., Ltd., Japan.
*2: Trimethyl propane trimethacrylate, "TMPT" manufactured by Shin Nakamura Chemical Co., Ltd., Japan
*3: Zinc acrylate, manufactured by Asada Chemical Ind. Co., Ltd., Japan.
*4: Zinc oxide, "No. 3 Zinc White" manufactured by Hakusui Chemical Ind., Co., Ltd., Japan.
*5: N,N'—phenylene dimaleimide, "Vulnoc PM" (N,N—m-phenylene dimaleimide) manufactured by Ouchi Shinko Chemical Ind. Co., Ltd., Japan.
*6: 2,2-methylene-bis (4-ethyl-t-butyl phenol), "Sundant 425" manufactured by Sanshin Chemical Ind. Co., Ltd., Japan.
*7: Dicumyl peroxide, "Percumyl D" manufactured by Nippon Oils & Fats Co., Ltd., Japan.
*8: n-butyl 4,4-bis (t-butyl peroxy) valerate Perhexa V manufactured by Nippon Oils & Fats Co., Ltd., Japan.

TABLE 2

| | Ex. 1 | Ex. 2 | Ex. 3 | Ex. 4 | Ex. 5 | Ex. 6 | Ex. 7 | Com. 1 | Com. 2 | Com. 3 | Com. 4 | Stnd. 1 | Com. 5 | Com. 6 |
|---|---|---|---|---|---|---|---|---|---|---|---|---|---|---|
| Inner Layer | | | | | | | | | | | | | | |
| Diameter: (mm) | 24.4 | 24.4 | 24.4 | 28.0 | 28.0 | 24.4 | 24.4 | | | | | | 24.4 | 24.4 |
| Surface Hardness: (Shore hardness D) | 30 | 27 | 18 | 18 | 15 | 30 | 18 | | | | | | 35 | 10 |
| Core | | | | | | | | | | | | | | |
| Diameter: (mm) | 38.3 | 38.3 | 38.3 | 38.3 | 38.3 | 37.2 | 37.2 | 38.3 | 38.3 | 37.2 | 37.2 | | 38.3 | 38.3 |
| Surface Hardness (Shore hardness D) | 64 | 62 | 62 | 64 | 56 | 64 | 62 | 60 | 47 | 61 | 49 | | 30 | 30 |
| Golf Ball | | | | | | | | | | | | | | |
| Weight: (g) | 45.2 | 45.2 | 45.1 | 45.3 | 45.3 | 45.1 | 45.2 | 45.2 | 45.3 | 45.2 | 45.2 | 45.2 | 45.2 | 45.1 |
| Diameter: (mm) | 42.71 | 42.70 | 42.71 | 42.72 | 42.72 | 41.20 | 41.20 | 42.71 | 42.71 | 41.20 | 41.21 | 42.70 | 42.72 | 42.72 |
| PGA Compression | 103 | 95 | 80 | 86 | 78 | 105 | 83 | 101 | 80 | 105 | 83 | 93 | 105 | 72 |
| Golf Ball Performance | | | | | | | | | | | | | | |
| Carry: (m) | 190.7 | 191.2 | 190.2 | 189.4 | 189.1 | 193.6 | 192.4 | 191.5 | 182.3 | 193.1 | 187.6 | 181.7 | 191.2 | 188.7 |
| Distance: (m) | 197.2 | 196.7 | 196.9 | 196.0 | 197.0 | 203.1 | 202.1 | 196.9 | 186.5 | 202.5 | 196.2 | 187.4 | 197.5 | 196.2 |
| Contact Area Percentage: (%) | 28.8 | 30.0 | 31.5 | 31.4 | 34.3 | 28.0 | 31.0 | 25.1 | 31.2 | 24.7 | 30.5 | 34.8 | 26.2 | 35.2 |
| Striking Response Received by Players | | | | | | | | | | | | | | |
| Head Speed of 46 m/s | ◎ | ◎ | Δ | Δ | Δ | ◎ | Δ | ○ | X | ○ | X | ◎ | ○ | X |
| Head Speed of 40 m/s | ○ | ◎ | ◎ | ○ | ○ | ○ | ◎ | X | X | X | X | ◎ | X | X |
| Head Speed of 32 m/s | Δ | ○ | ◎ | ◎ | ◎ | Δ | ◎ | X | Δ | X | X | ◎ | X | X |
| Ball's Control Capability, rated by Players | | | | | | | | | | | | | | |
| Head Speed of 46 m/s | ◎ | ◎ | ◎ | ◎ | ◎ | ◎ | ◎ | X | Δ | X | Δ | ◎ | X | ○ |
| Head Speed of 40 m/s | ◎ | ◎ | ◎ | ◎ | ◎ | ◎ | ◎ | X | Δ | X | Δ | ◎ | X | ◎ |
| Head Speed of 32 m/s | Δ | ○ | ◎ | ◎ | ◎ | Δ | ◎ | X | ○ | X | ○ | ◎ | X | ◎ |

Notes 1:
Ex. = Example, Com. = Comparative Example, Stnd. = Standard Example.
Notes 2:
◎= Excellent, ○= Good, Δ = Fair, X = Bad.

As stated above, generally used solid two-piece golf balls and solid three-piece golf balls having too hard an inner layer have a bad striking response and a low capability of being controlled. A golf ball having too soft a core also has a bad striking response and a low capability of being controlled. As described above, according to the present invention, a solid three-piece golf ball having a long flying distance, and excellent striking response and capability of being controlled with which the golfers in a wide range of grade are satisfied can be easily obtained.

We claim:

1. A solid three-piece golf ball having a core consisting of inner and outer layers, and a shell covering said core, characterized in that said inner layer has a diameter of 24–29 mm and a hardness (Shore hardness D) of 15–30, said outer layer having a diameter of 36–41 mm and a hardness (Shore hardness D) of 55–65, and the area of the portion of the surface of said golf ball which contacts a club face when said golf is struck by the club being 27–35% said area being determined by dividing the area of the portion of the surface of a ball which contacted the face of a driver (wood club #1) when the ball was struck by the driver at a head speed of 40 m/sec by the area of a diametrical cross section of the ball and multiplying the quotient by 100.

2. A solid three-piece golf ball according to claim 1, wherein said inner layer consists of a mixture of 100 parts by weight of cis-1,4-polybutadiene, 3–15 parts by weight of trimethylol propane trimethacrylate, and zinc oxide.

3. A solid three-piece golf ball according to claim 1, wherein said outer layer consists of a mixture of 100 parts by weight of cis-1,4-polybutadiene, 25–40 parts by weight of zinc diacylate, and zinc dioxide.

* * * * *